United States Patent [19]

Cavalli

[11] Patent Number: 4,565,019

[45] Date of Patent: Jan. 21, 1986

[54] STEAM IRON STAND WITH PIVOTABLE WATER RESERVOIR

[76] Inventor: Alfredo Cavalli, Via Galileo Galilei, 9, Pessano Con Bornago (Milan), Italy

[21] Appl. No.: 663,212

[22] Filed: Oct. 22, 1984

[30] Foreign Application Priority Data

| | | | |
|---|---|---|---|
| Oct. 24, 1983 | [IT] | Italy | 23333/83[U] |
| Mar. 23, 1984 | [IT] | Italy | 21338/84[U] |
| Mar. 23, 1984 | [IT] | Italy | 21339/84[U] |

[51] Int. Cl.[4] ..... D06F 75/40

[52] U.S. Cl. ..... 38/77.6; 38/79; 38/142; 16/378; 242/107.6; 248/146

[58] Field of Search ..... 38/142, 107, 77.6, 77.4, 38/88, 94, 82, 79, 96, 90, 74, 75; 242/107.6; 248/146, 51, 52; 203/11; 16/378, 379

[56] References Cited

U.S. PATENT DOCUMENTS

| | | | |
|---|---|---|---|
| 1,872,528 | 8/1932 | Temple | 38/142 |
| 3,078,605 | 2/1963 | Jepson | 38/77.6 |
| 3,460,789 | 8/1969 | McKirdy et al. | 248/146 |
| 3,964,207 | 6/1976 | Peterson | 16/378 X |
| 4,018,656 | 4/1977 | Rogers et al. | 203/11 |

FOREIGN PATENT DOCUMENTS

| | | | |
|---|---|---|---|
| 2408710 | 7/1979 | France | 16/378 |

*Primary Examiner*—Werner H. Schroeder
*Assistant Examiner*—Andrew M. Falik
*Attorney, Agent, or Firm*—Cohen, Pontani & Lieberman

[57] ABSTRACT

A steam iron assembly for domestic use includes an iron, a box-shaped base for supporting the iron, and a water reservoir pivotably mounted on the base for movement thereon as required. The base may also contain an automatic cablewinder and a water-softening filter. The steam iron assembly has notably reduced bulk in its inoperative position, but provides a wide surface for holding the iron during use thereof.

17 Claims, 11 Drawing Figures

STEAM IRON STAND WITH PIVOTABLE WATER RESERVOIR

The invention relates to a steam ironing assembly for domestic use of the kind comprising a base for holding an iron and a water reservoir in liquid communication with the iron.

Steam iron assemblies of the kind in question have enabled the advantages hitherto reserved to commercial ironing equipment to be transferred to the domestic level. More particularly, they provide a larger supply of water, thus improving the independent operation of the iron.

However there has also been a transfer of some disadvantages which may be acceptable at a commercial level but are serious and unacceptable domestically. More particularly, the ironing assemblies are laborious and difficult to use because of their bulk, which is considerable mainly because of electric cables and exposed water and/or steam pipes permanently mounted on telescopic supports, possibly with boilers and associated safety means.

The main object of the invention is to provide a steam ironing assembly for domestic use having structural and functional features which obviate the aforementioned disadvantages without reducing the performance or independence compared with similar steam ironing assemblies in domestic use.

This aim and others which will be clearer from the following description are obtained by a steam ironing assembly comprising a base for holding an iron and a water reservoir in liquid communication with the iron and characterised in that the reservoir is mounted on the base via a pivot coupling rotating around a vertical axis.

In a preferred embodiment, the assembly according to the invention is characterised in that it comprises a vertical shaft rigidly held by the base and a vertical cylindical seat rigidly associated with the reservoir and removably and pivotably coupled to the shaft.

According to the invention, the water reservoir can move relative to the base through an angle from an inoperative to an operative position. In the inoperative position the reservoir does not project from the side of the base and leaves a space on it just sufficient to receive an iron. In the operative position the reservoir projects from the side of the base and leaves more space for holding the iron during use.

Other features and advantages of a steam iron assembly according to the invention will be clear from the following description of a preferred embodiment with reference to the accompanying drawing in which.

Figure 1:
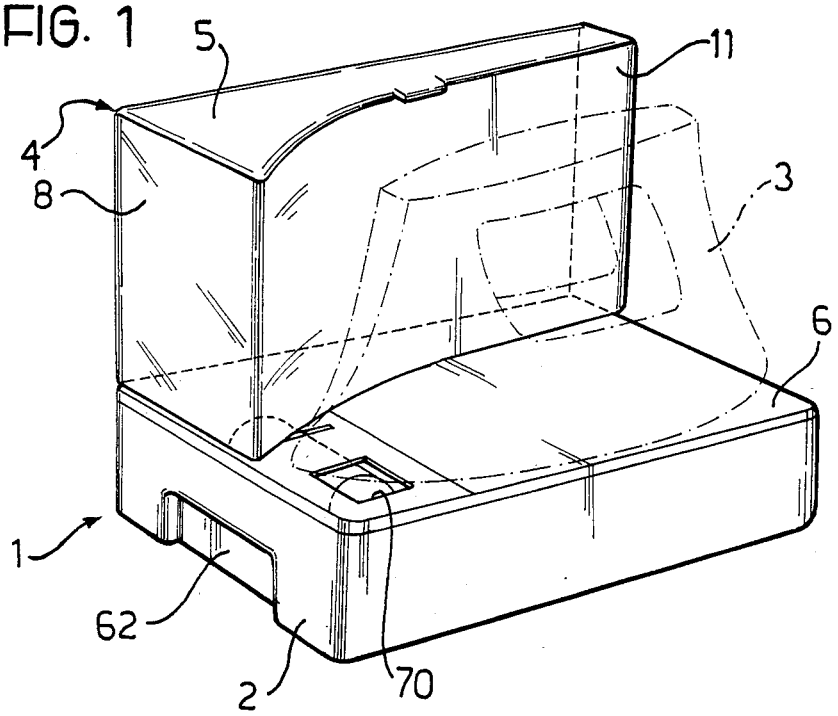
FIG. 1 is a perspective view of an ironing assembly according to the invention.
Figure 2:
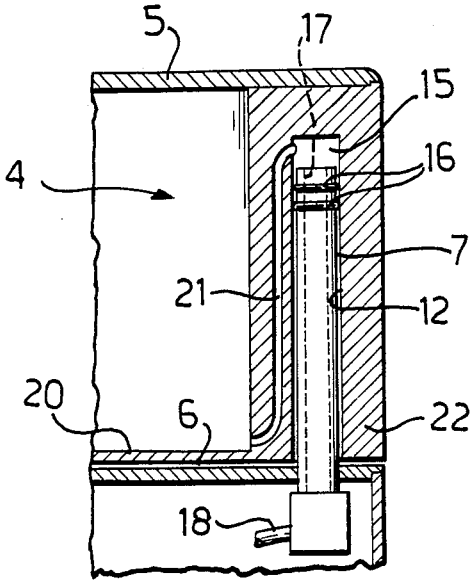
FIG. 2 shows a larger-scale section of a constructional feature of the assembly in FIG. 1.
Figure 5:
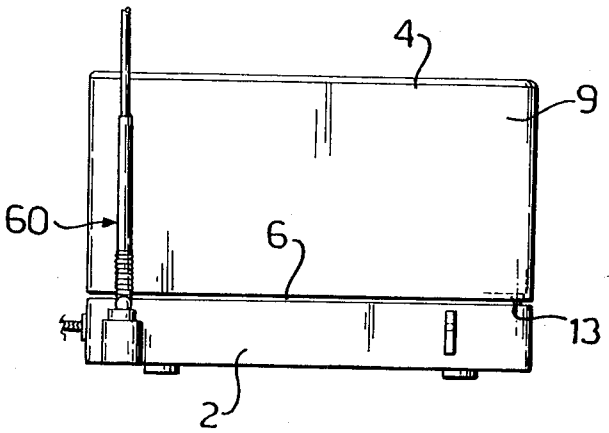
FIG. 5 is a smaller-scale view of the assembly in FIG. 1 from the rear.

In the drawings, the general reference 1 denotes a steam iron assembly for domestic use. Assembly 1 comprises a box-shaped base 2 having a top surface 6 forming a rest for an iron 3, and a water reservoir 4 closed at the top by a cover 5 and in liquid communication with iron 3 via a pipe 18.

Reservoir 4 is box-shaped and has three flat side walls 8, 9, 10 and a side wall 11 which is curved and concave towards base 2 and curves round iron 3 when resting on the base.

Figure 3:
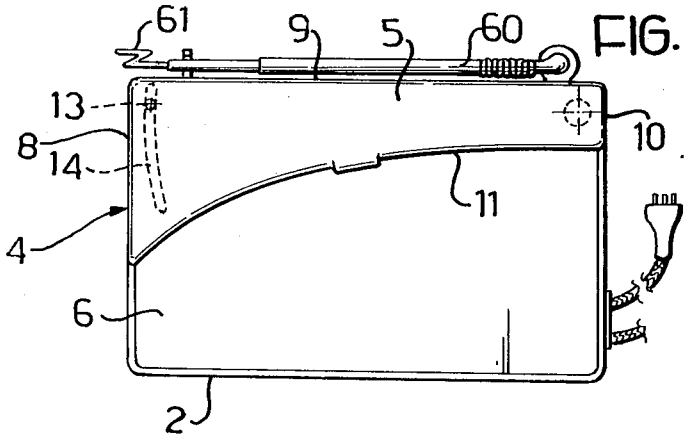
FIGS. 3 and 4 are reduced-scale plan views of the assembly in FIG. 1 in two different operating states.
Figure 4:
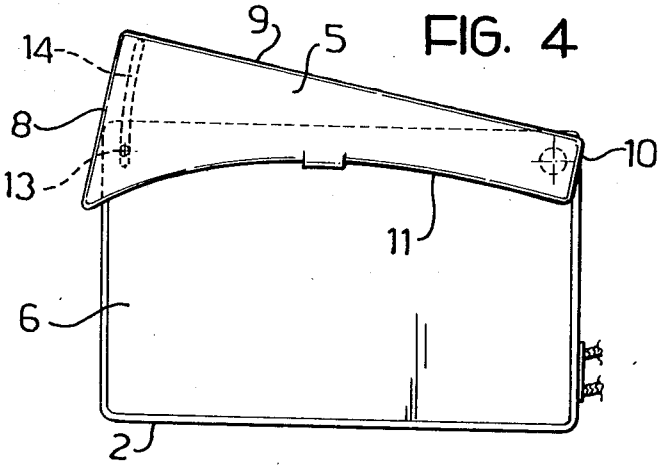
Figure 6:
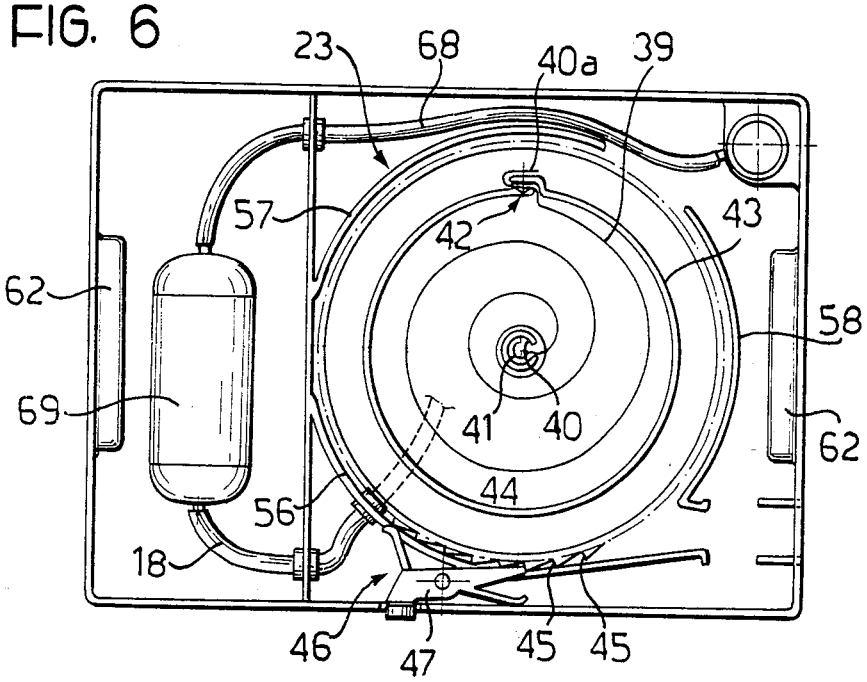
FIG. 6 is a plan view of a cable-winding device used in the assembly in FIG. 1.
Figure 7:
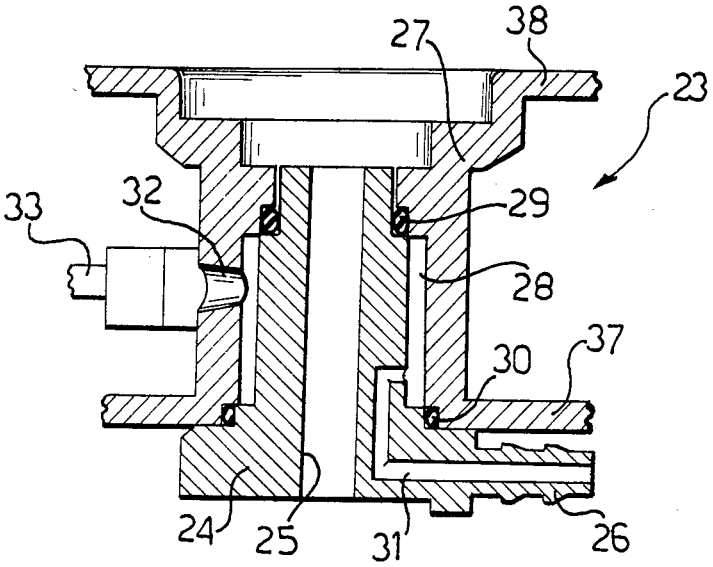
FIG. 7 is a larger-scale view in section of a constructional feature of the device in FIG. 6.
Figure 9:
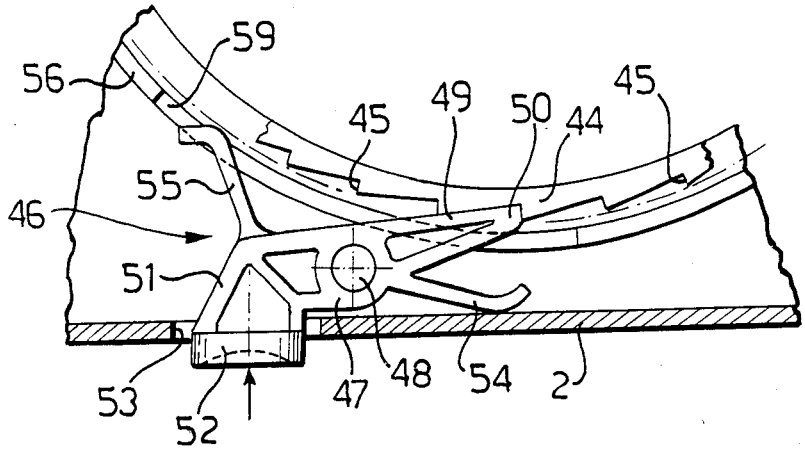
FIGS. 8 and 9 are larger-scale perspective and plan views respectively of other details of the device in FIG. 6.
Figure 8:
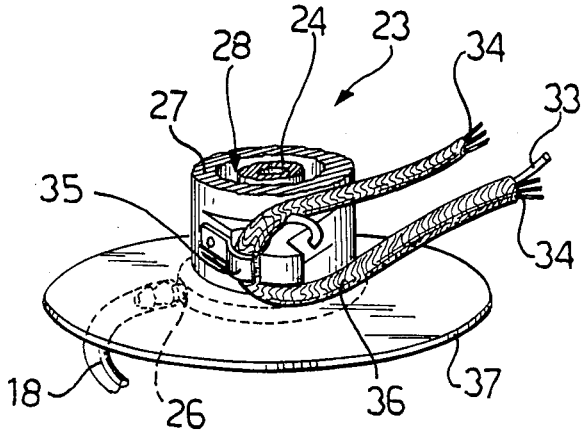
Figure 10:
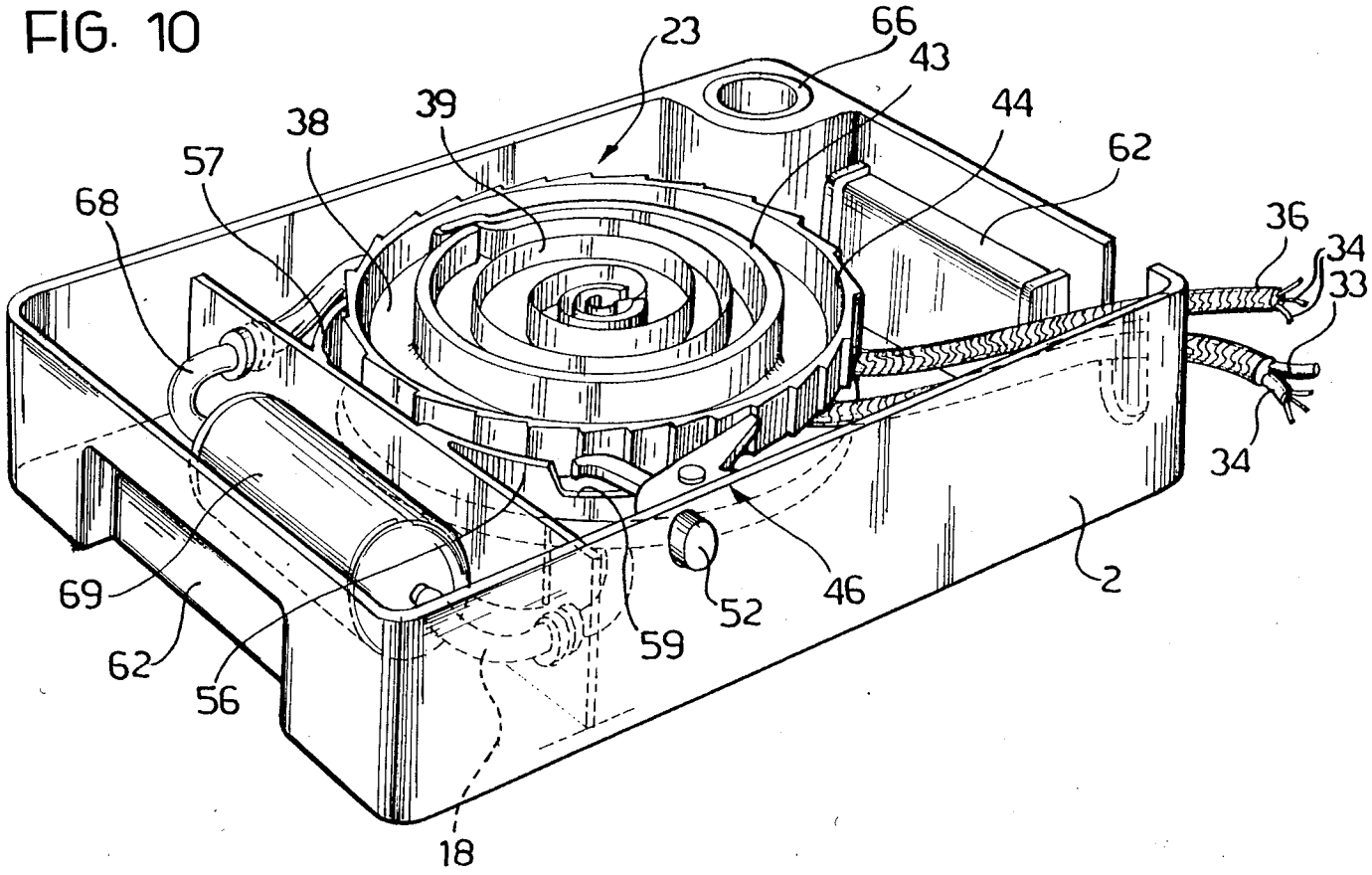
FIG. 10 is a larger-scale perspective view of the device in FIG. 6.

Reservoir 4 is secured to base 2 by a vertical-axis pivot coupling. More particularly, a solid portion 22 is secured to (or integrally formed with) the reservoir wall 10 and is formed with a blind hole 12 open towards the bottom and forming a seat for receiving a shaft 7 vertically secured at a peripheral position on surface 6. Shaft 7 and seat 12 are removably, rotatably and pivotably coupled. Reservoir 4 can thus move as required between an inoperative position of assembly 1 (FIGS. 1 and 3) and an operative position (FIG. 4). Means for limiting the angular motion of reservoir 4 comprise a stud 13 secured to base 2 and slidably engaging in a slot 14 in reservoir 4.

According to a feature of the invention, seat 12 has an axial length greater than shaft 7. Consequently a chamber 15 is defined in seat 12 above shaft 7 and is closed at the bottom by a pair of sealing rings 16.

Chamber 15 is in liquid communication, via a pipe 21 formed in the solid portion 22, with (a) reservoir 4 near its bottom 20 and (b) a flexible pipe 18 via an axial bore 17 in shaft 7. Reservoir 4 is thus in liquid communication with iron 3 via pipe 21, chamber 15, bore 17 and flexible pipe 18.

A cable-winding device (general reference 23) is disposed in base 2.

Device 23 comprises a hub 24 secured to base 2, e.g. by a bolt having a shank engaging through an axial bore 25 in hub 24.

A drum 27 is rotatably mounted on hub 24. An annular chamber 28 is formed between hub 24 and drum 27 and is closed at top and bottom by two sealing rings 29, 30.

A first pipe 31 formed in hub 24 opens at one end into chamber 28 and at the other end is connected to pipe 18 via a coupling 26.

A second pipe 32 formed in drum 27 opens into chamber 28 and communicates with iron 3 via a flexible pipe 33.

An electric cable 34 is secured to the outside of drum 27 by a connector 35. Pipe 33 and the part of cable 34 between drum 27 and iron 3 are covered by a single protecting sheath 36. Near drum 27, pipe 33 comes out of sheath 36 so as to be connected to pipe 32.

Drum 27 has two flanges 37, 38 bounding a seat for winding the electric cable 34 and flexible pipe 33.

A spiral spring 39 has an end 40 secured in a seat 41 in hub 24 and an end 40*a* secured in a seat 42 in an annular projection 43 of the top flange 38. At its periphery, flange 38 has a cylindrical ring 44 formed with tangential teeth 45 having a triangular cross-section. A ratchet mechanism 46 acting on ring 44 comprises a lever 47 pivoted to base 2 by a pin 48. A first arm 49 of lever 47 has an end 50 shaped so as to intimately to follow teeth 45; a second arm 51 has an end 52 forming a press-button which projects from base 2 through an aperture 53.

Lever 47 also comprises two resilient projections 54, 55. Projection 54 is in contact with the wall of base 2 and forms a resilient means which opposes disengagement of arm end 50 from teeth 45. The other resilient projection 55 is in sliding engagement on ring 44 when the press-button end 52 is pressed, so that drum 27 is braked during the rewinding of cable 32 and pipe 31.

Partitions 56, 57, 58 are disposed around cable-winder 23 at the winding chamber. Partition 56 has a recess 59 at the ratchet mechanism 46.

Reference 60 denotes a telescopic antenna having a top end 61 which is curved so as to receive the sheath 36 holding pipe 33 and cable 34 when iron 3 is in use.

Base 2 also has two handles 62 for lifting the assembly according to the invention and moving it when required.

As the preceding description shows, the steam iron assembly 1 according to the invention, when not in use, is in a position such that reservoir 4 is disposed on top of base 2 without projecting over its edge. The only free space left on the bearing surface 6 is the space strictly necessary to receive the iron 3. In this state, of course, assembly 1 has the minimum bulk and is thus easy to handle and transport.

This advantage is further increased by the fact that the water pipes and electric cable are completely wound inside the box-shaped base, and the winding process is automatic. A particularly important technical feature in this regard is that the hydraulic connection between reservoir 4 and iron 3 is made inside the actual reservoir, which is advantageously made of transparent plastics so that the level of liquid is directly visible.

During ironing, reservoir 4 can be moved on its pivot out of base 2, thus releasing more space on surface 6 for holding the iron 3. In this operating state, the electric cable and flexible water pipe are completely unwound by cable-winder 23. Water is supplied from reservoir 4 to iron 3 by conventional means, such as a hand pump mounted on the iron. The water reaches the annular chamber 28 and then flows through pipe 30 and supplies iron 3. The angular position of drum 27 has no influence since chamber 28 is annular.

When required, the cable and pipe can be rewound simply by pressing the push-button end 51. This releases the other end 50 from ring 44 and the released drum 27 is rotated by spring 38 so as to re-wind as required. Re-winding is gradual owing to the pressure of projection 55 on ring 44. The re-winding of the electric cable and flexible water pipe is guided by the partitions 56, 57 and 58.

Figure 11:
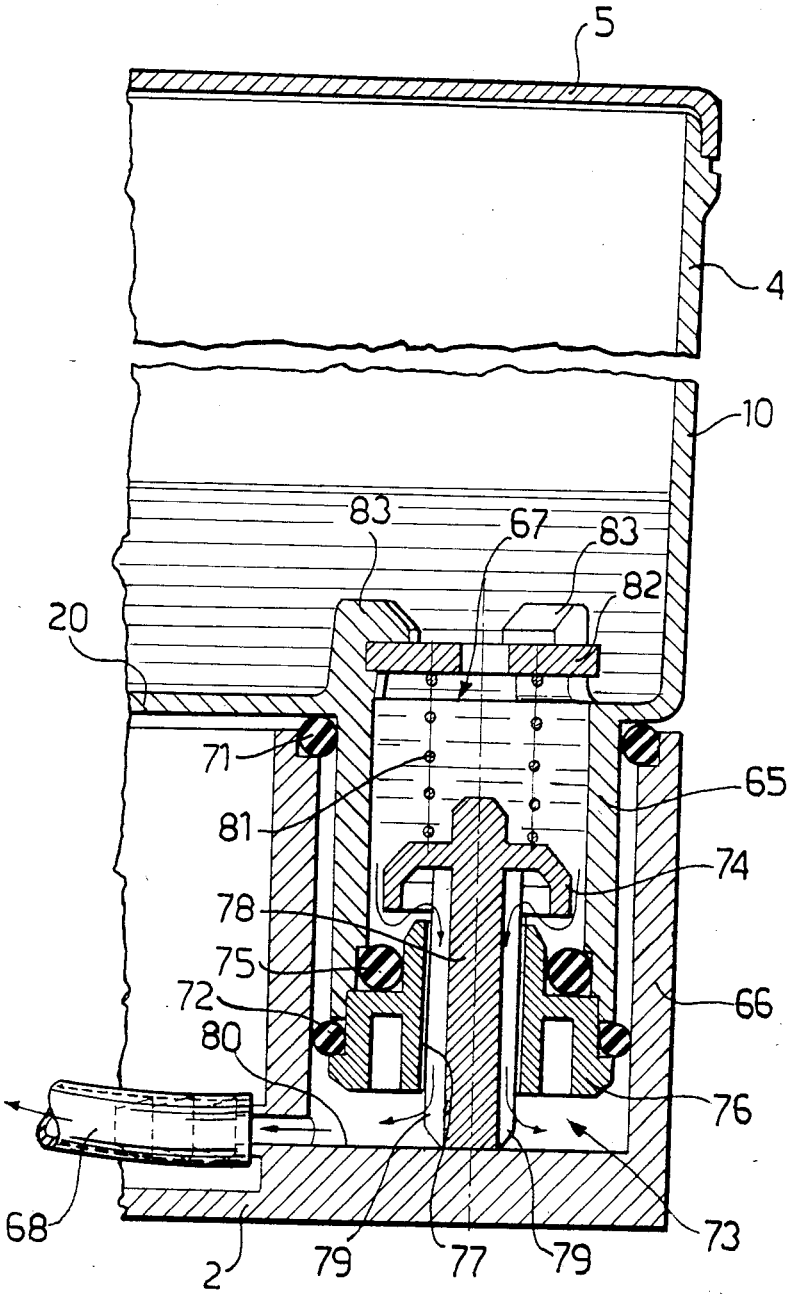
FIG. 11 is a larger-scale view in section of a variant of the feature in FIG. 2.

In the variant in FIG. 11, the pivot coupling between reservoir 4 and base 2 is constructed as follows. Reservoir 4 has a sleeve 65 projecting downwards from its bottom and adapted to engage rotatably and removably in a cylindrical well 66 of corresponding size formed in base 2. Suitable seals 71, 72 are interposed between sleeve 65 and well 66.

At the place corresponding to sleeve 65, the bottom of reservoir 4 is formed with an aperture 67 through which water flows from reservoir 4 through sleeve 65 into well 66. Well 66 is in liquid communication via a pipe 68 with a water-softening filter 69 disposed in a part of base 2 separated from cable-winder 23 and closed at the top by a cover 70 which is transparent for inspecting the operating state of filter 69. Filter 69 is in liquid communication with iron 3 via pipe 18.

Sleeve 65 contains a valve means 73 for interrupting the flow of water when reservoir 4 is removed from base 2. Means 73 comprises a closure means 74 acting against a seal 75 supported by a member 76 secured to the end of sleeve 65. Member 76 is formed with an axial bore 77 for guiding a rod 78 secured to closure means 74. Rod 78 has longitudinal ribs 79 through which water can flow along bore 77. Rod 78 has a length such as to make contact with the bottom 80 of well 66 when sleeve 65 is inserted, thus detaching closure means 74 from seal 75. Means 74 are resiliently held against seal 75 by a spring 81 compressed between means 74 and a ring 82 held by hooked projections 85 formed at the bottom of reservoir 4 around aperture 67.

All variants of the structural features previously described and within the scope of the skilled addressee will be considered technical equivalents and therefore within the scope of protection defined in the following claims.

I claim:

1. A steam iron assembly for domestic use comprising a base for an iron and a water reservoir in liquid communication with the iron via a pivotable coupling, characterised in that the reservoir (4) is mounted on the base (2) by the pivot coupling (7), (12) having a vertical axis of rotation, and that the pivot coupling comprises a vertical shaft (7) rigidly held by the base (2) and a vertical cylindrical seat (12) rigidly associated with the reservoir (4) and removably and rotatably coupled to the shaft (7).

2. An assembly according to claim 1, characterised in that the reservoir (4) is in liquid communication with the iron (3) via a pipe having a portion (17) extending in the shaft (7).

3. An assembly according to claim 2, characterised in that the pipe portion is a through bore (17) axially formed in the shaft (7) and in liquid communication at one end with a chamber (15) formed in the seat (12) above the shaft (7), the chamber (15) being in liquid communication with the reservoir (4) near the bottom (20) thereof.

4. An assembly according to claim 3, characterised in that the reservoir (4) is rigidly associated with a solid portion (22) formed with the cylindrical seat (12) and chamber (15).

5. An assembly according to claim 4, characterised in that the chamber (15) is in liquid communication with the reservoir (4) via a pipe (21) formed in the solid portion (22) and opening at one end into the chamber (15) and at the other end into the reservoir (4) near its bottom (20).

6. An assembly according to claim 1, characterised in that the base (2) is box-shaped and the assembly comprises a cable-winding device (23) mounted in the base (2).

7. An assembly according to claim 6, characterised in that the cable-winding device (23) comprises:

a hub (24) rotatably secured in the base (2), a drum (27) rotatably mounted on the hub (24);

an annular chamber (28) formed between the hub (24) and the drum (27);

a first pipe (31) formed in the hub (24), one end of the pipe communicating with the annular chamber (28) and the other end communicating with the reservoir (4);

a second pipe (32) formed in the drum (27) and opening at one end into the annular chamber (28) and in liquid communication at the other end with the iron (3) via a flexible pipe (33); and a connector (46) on the drum (27) for holding the flexible pipe (33) with one end abutting the second pipe (32).

8. An assembly according to claim 7, characterised in that the connector (46) also holds an electric cable (34) for supplying the iron (3), the cable (34) and the pipe (33) being covered by a single protective sheath (36).

9. An assembly according to claim 8, characterised in that the cable-winding device (23) comprises:

a spiral spring (39) acting between the hub (24) and drum (27) to oppose rotation by the drum (27) during the unwinding of the cable (36);

a cylindrical ring (44) on the drum and having a number of tangential teeth (45), and a ratchet and pawl (46) co-operating with the ring (44) and actuatable from outside the base (2).

10. An assembly according to claim 9 characterised in that the ratchet and pawl (46) comprise a lever (47) pivoted to the base (2) and having a first arm (49) having its end engaging the teeth (45) in the ring (44) and a second arm (51) having a press-button shaped end (52) projecting outside the base (2), resilient means (54) being provided for opposing angular motion of the lever (47) around pin (48) in the direction for disengaging the arm (49) from teeth (45).

11. An assembly according to claim 10, characterised in that the ratchet and pawl (46) also comprise a braking element (55) comprising a resiliently deformable projection secured to lever arm (51) and in sliding engagement with ring (44).

12. An assembly according to claim 1, further comprising a water-softening filter (69).

13. An assembly according to claim 12, characterised in that the filter (69) is disposed in the base (2) and is in liquid communication with (a) the well (66) via a flexible pipe (68) and (b) with the iron (3) via a flexible pipe (18).

14. An assembly according to claim 1, characterised in that the pivot coupling is formed at a peripheral position relative to the base (2) and reservoir (4).

15. An assembly according to claim 14, characterised in that the reservoir (4) is transparent.

16. A steam iron assembly for domestic use comprising a base for an iron and a water reservoir in liquid communication with the iron, characterised in that the reservoir (4) is mounted on the base (2) by a pivot coupling (7), (12) having a vertical axis of rotation and that the pivot coupling comprises:

a cylindrical well (66) formed in the base (2) and in liquid communication with the iron (3);

a sleeve (65) rigidly associated with the reservoir (4) and removably inserted into the well (66) and pivotably and slidably engaged therein;

an aperture (67) at the bottom (20) of reservoir (4) and corresponding to sleeve (65); and a valve means (73) for intercepting the flow of water in sleeve (65) to prevent water running out when the reservoir (4) is removed from the base (2).

17. An assembly according to claim 16, characterised in that the valve means (73) comprises a closure means (74) acting on a seal (75) and means (78) for removing the closure means (74) from the seal (75) against the action of spring means (81).

* * * * *